US010555846B2

(12) United States Patent
Jacobsson

(10) Patent No.: US 10,555,846 B2
(45) Date of Patent: Feb. 11, 2020

(54) DRIVE UNIT FOR A WHEELCHAIR AND A WHEELCHAIR PROVIDED WITH SUCH A DRIVE UNIT

(71) Applicant: DECON WHEEL AB, Hyltebruk (SE)

(72) Inventor: Magnus Jacobsson, Broaryd (SE)

(73) Assignee: DECON WHEEL AB, Hyltebruk (SE)

( * ) Notice: Subject to any disclaimer, the term of this patent is extended or adjusted under 35 U.S.C. 154(b) by 46 days.

(21) Appl. No.: 15/575,568

(22) PCT Filed: Mar. 30, 2016

(86) PCT No.: PCT/SE2016/050266
§ 371 (c)(1),
(2) Date: Nov. 20, 2017

(87) PCT Pub. No.: WO2016/204668
PCT Pub. Date: Dec. 22, 2016

(65) Prior Publication Data

US 2018/0133075 A1 May 17, 2018

(30) Foreign Application Priority Data

Jun. 16, 2015 (SE) ..... 1530087

(51) Int. Cl.
*A61G 5/04* (2013.01)
*B60K 1/02* (2006.01)
*A61G 5/10* (2006.01)

(52) U.S. Cl.
CPC ..... *A61G 5/047* (2013.01); *A61G 5/045* (2013.01); *A61G 5/048* (2016.11); *A61G 5/1051* (2016.11);
(Continued)

(58) Field of Classification Search
CPC ..... A61G 5/047; A61G 5/048; A61G 5/045; A61G 5/1083; A61G 5/1097; A61G 5/041;
(Continued)

(56) References Cited

U.S. PATENT DOCUMENTS 3,351,148 A 11/1967 Solomon
3,719,247 A * 3/1973 Hollis ..... B62B 1/042 180/19.3
(Continued)

FOREIGN PATENT DOCUMENTS

DE 3923809 * 1/1991 ..... A63B 55/08
EP 0 925 771 B1 6/1999
(Continued)

OTHER PUBLICATIONS

International Search Report, dated May 11, 2016, from corresponding PCT/SE2016/050266 application.
(Continued)

*Primary Examiner* — Anne Marie M Boehler
(74) *Attorney, Agent, or Firm* — Young & Thompson

(57) ABSTRACT

Disclosed is a drive unit for a wheelchair and a wheelchair including such. The wheelchair includes a control input and a structural frame with two lateral frame elements, each supporting a drive wheel. The drive unit includes two drive motors within a driveshaft housing, adapted to drive the drive wheels independently based on input via the control input. The drive shaft housing is releasably attached between the two lateral frame elements of the wheelchair and connected to the drive wheels via quick-release couplings. The drive shaft housing is divided into at least two sections, each section housing one of the drive motors and that the at least two sections of the drive shaft housing are telescopically moveable relative to each other for adjusting the width of the
(Continued)

drive shaft housing to different wheelchairs having different distances between the lateral frame elements of the structural frame of the wheelchair.

20 Claims, 6 Drawing Sheets

(52) U.S. Cl.
CPC ..... *A61G 5/1054* (2016.11); *A61G 2203/14* (2013.01); *A61G 2203/38* (2013.01)

(58) Field of Classification Search
CPC ..... B60K 2006/266; B60K 1/02; B60K 2007/0092; B60K 7/0007; B62B 5/005
USPC ..... 180/6.5, 6.48, 11, 907, 208, 209; 280/43.15, 43.16
See application file for complete search history.

(56) References Cited

U.S. PATENT DOCUMENTS

| | | | | | |
|---|---|---|---|---|---|
| 3,770,073 | A | | 11/1973 | Meyer | |
| 4,125,169 | A | * | 11/1978 | Harris | A61G 5/02 180/6.5 |
| 4,576,389 | A | * | 3/1986 | Villaveces | B62B 3/00 267/41 |
| 5,234,066 | A | | 8/1993 | Ahsing et al. | |
| 5,253,724 | A | * | 10/1993 | Prior | A61G 5/045 180/6.5 |
| 5,762,154 | A | * | 6/1998 | Hsu | A61G 5/047 180/15 |
| 5,996,716 | A | * | 12/1999 | Montiglio | A61G 5/045 180/6.5 |
| 6,050,356 | A | | 4/2000 | Takeda et al. | |
| 6,155,367 | A | | 12/2000 | Alber | |
| 6,547,018 | B1 | | 4/2003 | Choi | |
| 7,163,227 | B1 | * | 1/2007 | Burns | B60B 35/1054 180/906 |
| 7,383,904 | B2 | | 6/2008 | Wu | |
| 2016/0158078 | A1 | * | 6/2016 | Kim | A61G 5/041 180/6.5 |
| 2019/0134474 | A1 | * | 5/2019 | Schneiter | B60K 7/00 |

FOREIGN PATENT DOCUMENTS

| | | | |
|---|---|---|---|
| EP | 0 945 113 | B1 | 9/1999 |
| EP | 2 671 555 | A1 | 12/2013 |
| EP | 2 729 108 | B1 | 5/2014 |
| GB | 1 287 122 | A | 8/1972 |
| JP | H08-196572 | | 8/1996 |
| WO | 2007-049301 | | 5/2007 |
| WO | 2012/04446 | * | 8/2012 |

OTHER PUBLICATIONS

Extended European Search Report for Application No. 16812037, dated Nov. 27, 2018.

* cited by examiner

DRIVE UNIT FOR A WHEELCHAIR AND A WHEELCHAIR PROVIDED WITH SUCH A DRIVE UNIT

TECHNICAL FIELD

The invention relates to a drive unit for a wheelchair and a wheelchair comprising said drive unit. The drive unit is adapted to be an add-on accessory for a conventional hand-operated wheelchair, enabling a driver-demand power assist function to the wheelchair.

BACKGROUND

There are many known electrical drive units for wheelchairs, both arranged as the main power supply of the wheelchair and as auxiliary power assist units for conventional wheelchairs with push rims. Typically, a wheelchair designed primarily for full-time electrical drive tends to be heavier and therefore more cumbersome to use than the lighter conventional wheelchairs equipped with auxiliary power-assist drive units. The latter type typically include electric motors mounted either in the hub of the two main wheels of the wheelchair or as electric motor assemblies with auxiliary drive wheels mounted between the main wheels—either permanently fixed or removably fixed to the wheelchair.

An example of a relatively light-weight auxiliary drive unit is described in the European patent application EP 2729108 (A2), Motion-Based Power Assist System for Wheelchairs. It includes a drive motor unit and a single auxiliary drive wheel mounted between the main-wheels of a wheelchair. The unit can be easily connected and disconnected to a conventional wheelchair and has a motion based sensor system which adapts the drive power to a degree decided by the driver of the wheelchair. One drawback with a single auxiliary drive wheel is that the available traction may be limited when compared to drive units that drive the main wheels of the wheel chair. This is particularly noticeable in poor road conditions with slippery road surfaces.

Hub-mounted power assist motors are compact and offer good traction via the main wheels. One drawback with hub-mounted auxiliary drive motors, however, is that the weight of the motors cannot be removed if the driver wishes to use the wheelchair in an entirely conventional way by using hand power only. An example of a known hub mounted drive unit is described in U.S. Pat. No. 7,383,904 B, Auxiliary Power Unit Starting Apparatus for a Wheelchair. Other examples of hub-mounted power assist motors may be studied in European Patents EP 0 925 771 B1, Wheelchair with Auxiliary Power and EP 0945 113 B1, Auxiliary Propelling Device for Wheelchair Propelled by a Patient, respectively.

Examples of wheelchairs designed primarily for full-time electrical drive include a design described in British Patent Publication GB 1287122(A), A Foldable Invalid Chair. This prior art design typically represents many similar designs where the drive motors are positioned in parallel but not coaxially with the rotational axis of the main wheels. Other designs include drive motors positioned perpendicularly to the rotational axis of the main wheels. Cumbersome and often heavy angled transmissions are used in order to transfer necessary power to the drive wheels. As mentioned initially, these designs offer good traction but tend to add considerable weight to the wheelchair due to their bulky motors and transmissions which make them less suitable for example in situations where the wheelchair needs to be lifted.

In U.S. Pat. No. 5,234,066, Power Assisted Wheelchair, a drive unit is disclosed that offers an auxiliary drive unit that is configured to allow removal of the drive unit and folding of the wheelchair when not in use. The drive unit includes a relatively large box-shaped housing for two drive motors positioned in parallel but not coaxially with the rotational axis of the main wheels, hence needing space-consuming and heavy gear transmissions to drive both main wheels. Due to the relatively large size of the box-shaped housing and the added weight of the gear transmissions, this drive unit becomes cumbersome and heavy to handle for a user when it is to be removed from or installed into the wheelchair. Furthermore, the box-shaped drive unit is not width-adaptable to allow installation in wheelchairs of various track distances between the two main wheels, which is a desirable feature if the drive unit is to fit different wheelchairs from a plurality of wheelchair manufacturers. Lastly, the drive unit described in U.S. Pat. No. 5,234,066 does allow adjustment of the camber angle between the main drive wheels.

SUMMARY

Consequently, an object of the invention is to provide a drive unit for a wheel chair and a wheelchair comprising such a drive unit which solves the above-mentioned problems related to prior art and provides a solution which offers excellent traction, is compact, lightweight and easy to connect or disconnect from wheelchairs of various track distances between the main wheels. Another object of the invention is to offer a design which preferably also allows adjustment of the camber angle between the main drive wheels.

The objects are achieved by drive unit for a wheelchair and a wheelchair comprising such a drive unit. The wheelchair comprises control input means and a structural frame with two lateral frame elements, each supporting a drive wheel. The Drive unit comprises two drive motors mounted within a drive shaft housing and adapted to drive the drive wheels independently of each other based on control input from a driver via the control input means. The drive shaft housing is releasably attached between the two lateral frame elements of the wheelchair and connected to the drive wheels via quick-release couplings arranged at each distal end of the drive shaft housing. The invention is especially characterized in

- that the drive shaft housing is divided into at least two sections, each section housing one of said drive motors;
- that the at least two sections of the drive shaft housing are telescopically moveable relative to each other for adjusting the width of the drive shaft housing to different wheelchairs having different distances between the lateral frame elements of the structural frame of the wheelchair.

In a preferred embodiment of the invention, the two sections of the drive shaft housing are arranged to be angled relative to each other so as to allow an adjustment of the camber angle of the drive wheels.

Preferably the drive motors are positioned coaxially relative to the respective rotational axis of the drive wheels. The drive shaft housing is substantially cylindrically shaped and arranged to be installed in coaxial alignment with to the rotational axis of the drive wheels.

In a favourable embodiment of the invention, the drive shaft housing is divided into three sections comprising a central outer sleeve and two lateral inner sleeves containing the drive motors. At least one of said two inner sleeves is telescopically moveable within the central outer sleeve in the axial direction of the drive unit. Preferably, the central outer sleeve is formed as a two truncated cones adjoined at the base of the cones. The two lateral sleeves are cylindrical and each contain a drive motor. The outer diameter of the lateral sleeves essentially corresponds to the inner diameter of the top of the truncated cones of the central outer sleeve in such a way that the lateral sleeves may be angled within the central outer sleeve so as to allow an adjustment of the camber angle of the drive wheels.

In an alternative embodiment of the invention the two sections of the drive shaft housing are attached to each other via a hinge pin so as to allow an adjustment of the camber angle of the drive wheels. Each section includes sub-portions, one of which is telescopically moveable with respect to the other in the axial direction of the drive unit in order to allow width adjustment of the drive unit. The two sections of the drive shaft housing each comprises a locking lug having a plurality of apertures arranged along a curved geometrical symmetry line to overlap and coincide with apertures on the opposite locking lug. The locking lugs are arranged to be interlocked with a common locking bolt in such a way that only one opposite pair of apertures overlap and coincide at a certain angle between the two sections, corresponding to a certain camber angle of the drive wheels.

In a preferred embodiment of the invention, each drive motor is operatively connected to a clutch for connecting and disconnecting the drive wheels from the drive motors.

In a favourable embodiment of the invention the control input means includes push rims attached to each drive wheel. In this embodiment, the drive unit further includes a drive control system for receiving drive control input from sensors coupled to the push rims of both drive wheels. The sensors are adapted to detect a driver-requested drive torque for each drive wheel based on the driver's detected hand force transferred to the push rims of the drive wheels.

In an alternative embodiment of the invention, the control input means includes a joystick. Furthermore, in a favourable embodiment, the drive motors are electric motors and that the drive unit includes a power supply and control interface unit allowing power supply to the drive motors from an external battery pack and connection with said control input means.

The invention provides advantages over previously known technology, primarily due to the fact that it offers a compact, lightweight design which is easy to connect or disconnect from wheelchairs of various track distances between the main wheels and allows swift adjustment of the camber angle between the main drive wheels.

The invention also includes a wheelchair comprising a drive unit according to any of the preceding claims.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples only.

DETAILED DESCRIPTION OF EXAMPLE EMBODIMENTS OF THE INVENTION

Figure 1:
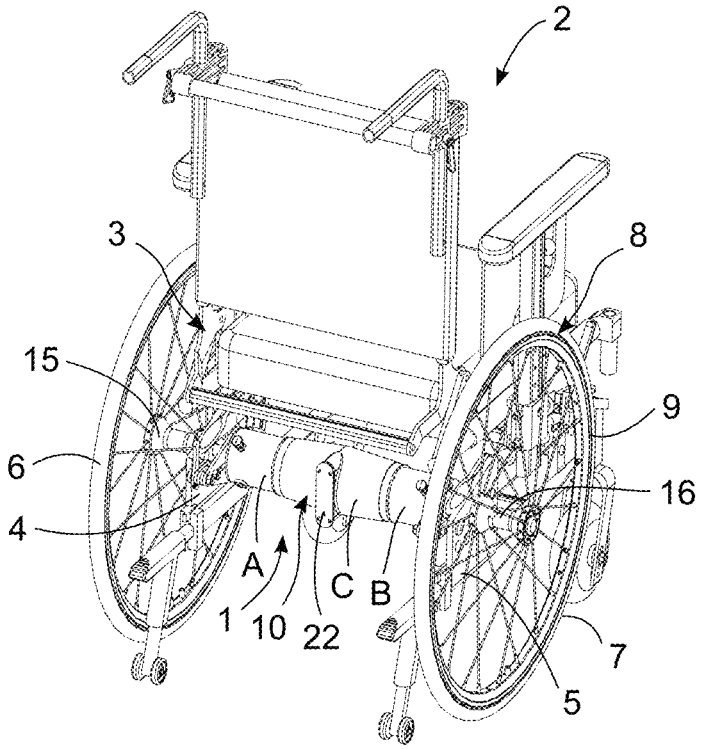
FIG. 1 shows a first embodiment of the invention with reference to perspective view of a wheelchair with the drive unit installed and ready for use.

The invention will now be described with reference to embodiments of the invention and with reference to the appended drawings. With initial reference to FIG. 1, there is shown a first exemplifying embodiment of the drive unit 1 and wheelchair 2 of invention. FIG. 1 is a perspective view of a wheelchair 2 with the drive unit 1 installed and ready for use.

Still with reference to FIG. 1, the wheelchair 2 has a structural frame 3 with two lateral frame elements 4, 5 each supporting a drive wheel 6, 7. The wheelchair 2 further comprises control means 8 which in the shown embodiment includes push rims 9 attached to each drive wheel 6, 7. In an alternative embodiment the control means 8 may instead include a joystick in a manner known per se (not shown). In the shown embodiment however, the drive unit 1 is adapted to be an add-on accessory for a conventional hand-operated wheelchair 2, enabling a driver-demand power assist function to the wheelchair 1. To this end, the drive unit 1 further includes a drive control system (not shown) for receiving drive control input from sensors coupled to the control means 8, in the shown example represented by the push rims 9 of both drive wheels 6, 7. The sensors may be of a number of commercially available variants and are not shown per se in the drawings, but they are adapted to detect a driver-requested drive torque for each drive wheel based on the driver's detected hand force transferred to the push rims 9 of the drive wheels 6, 7.

Figure 2:
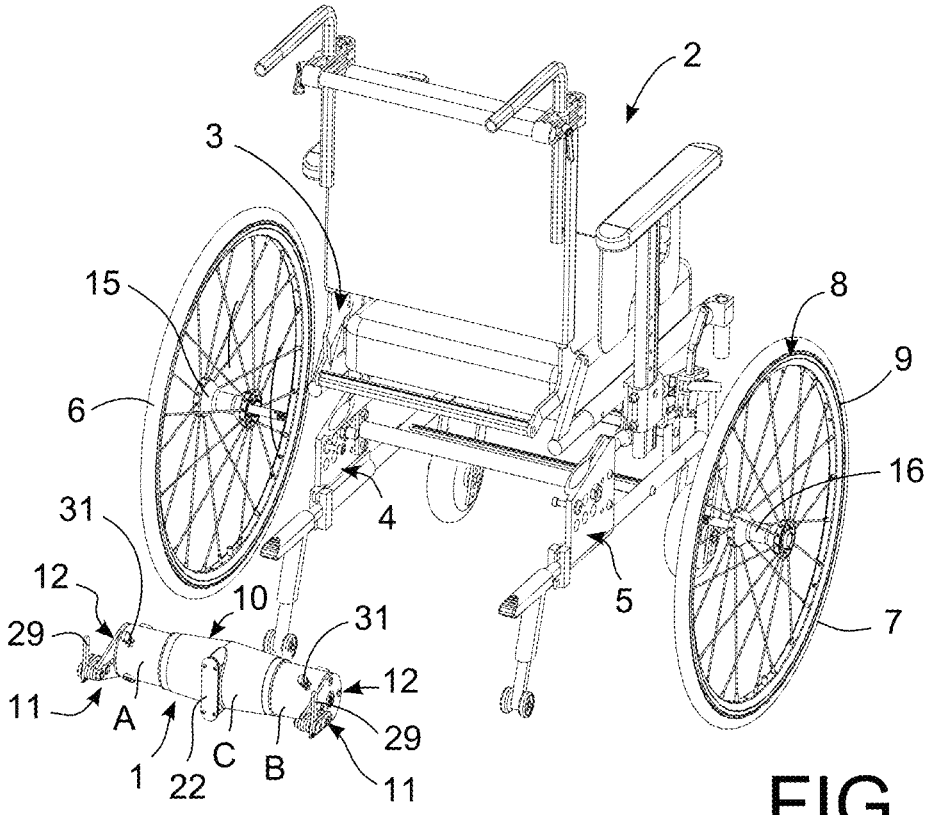
FIG. 2 shows a perspective view of the wheelchair with the drive unit and the drive wheels removed from the wheelchair.

In FIG. 2 the drive unit 1 and the drive wheels 6, 7 are shown removed from the wheelchair 2. This is achieved by a drive shaft housing 10 which is releasably attached between the two lateral frame elements 4, 5 of the wheelchair 2 and connected to the drive wheels 6, 7 via a quick-release coupling 11 arranged at each distal end 12 of the drive shaft housing 10. It becomes clear in FIG. 2 that the invention offers a compact, lightweight design which is easy to connect or disconnect from the wheelchair 2. Of course, the drive wheels may conveniently be retained on the wheelchair if the driver wants to use it without the drive unit 1.

Figure 3:
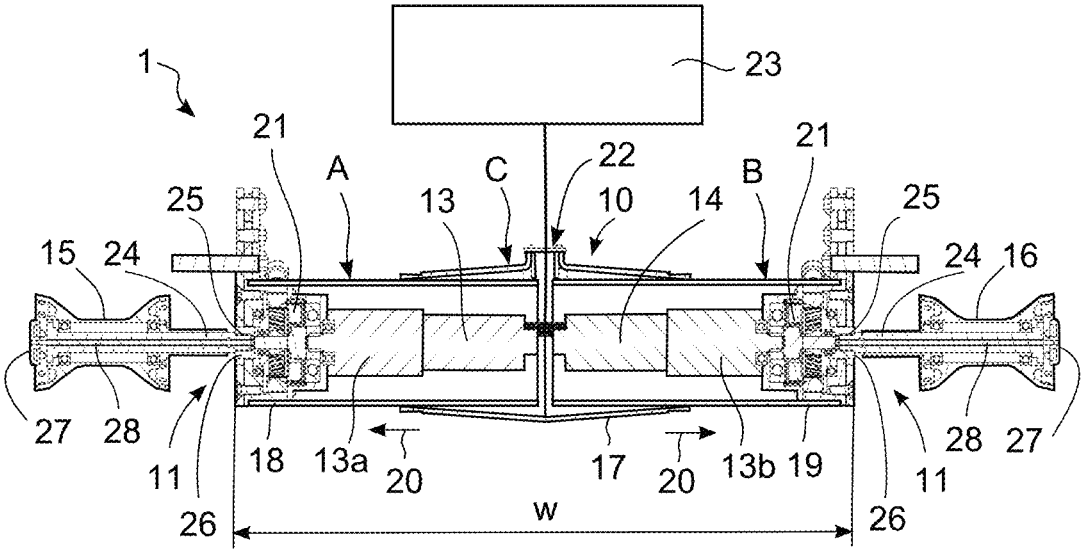
FIG. 3 shows a cross sectional view of the drive unit according to the first embodiment as shown in FIGS. 1 and 2.

In FIG. 3, a cross sectional view is shown of the drive unit 1 according to the first embodiment as shown in FIGS. 1 and 2. As seen in the figure, the drive unit 1 comprises two drive motors 13, 14 mounted within the drive shaft housing 10. The drive motors 13, 14 are equipped with gearboxes 13*a* and 13*b* and are adapted to drive the drive wheels 6, 7 independently of each other based on control input from a driver via the control input means 8 mentioned previously. In the figure, only the hub assemblies 15, 16 of the drive wheels 6, 7 are shown. A distinctive feature of the invention is that the drive shaft housing 10 is divided into at least two sections A, B, each section housing one of said drive motors 13, 14. The sections A, B are telescopically moveable relative to each other for adjusting the width w of the drive shaft housing 10 to different wheelchairs having different distances between the lateral frame elements 4, 5 of the structural frame 3 of the wheelchair 2. In the exemplifying embodiment shown in FIG. 3, the drive shaft housing 10 is more particularly divided into three sections A, B, C comprising a central outer sleeve 17 and two lateral inner sleeves 18 and 19, respectively. The lateral inner sleeves 18, 18 contain the drive motors 13, 14, and are telescopically moveable within the central outer sleeve 17 in the axial direction of the drive unit 1, as indicated by the arrows 20.

In order to obtain a lightweight overall design for convenient daily use the drive motors 13, 14 are positioned coaxially relative to the respective rotational axis of the drive wheels 6, 7. This saves valuable space and weight by eliminating the need for heavy and cumbersome angular gearboxes as found in prior art designs.

Furthermore, the drive shaft housing 10 is substantially cylindrically shaped and arranged to be installed in coaxial alignment with to the rotational axis of the drive wheels 6, 7, again for obtaining a compact and lightweight overall design. As a comparison with known auxiliary drive units, the drive unit 1 of the invention can be made at least half the weight of comparable designs, and often more than that.

Figure 4:
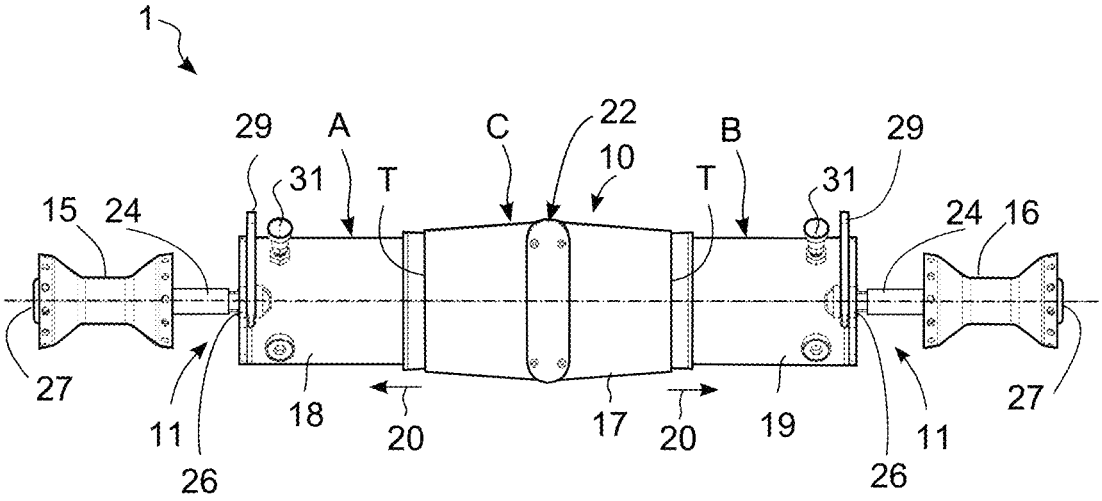
FIG. 4 shows an external view of the drive unit previously shown in FIG. 3.

As clearly shown in the external view of FIG. 4, the central outer sleeve 17 is formed as a two truncated cones 17*a* and 17*b* adjoined at the base of the cones. The two lateral sleeves 18, 19 are essentially cylindrically shaped and each contains a drive motor 13, 14 as shown in the cross-sectional view of FIG. 3. The outer diameter of the lateral sleeves 18, 19 essentially corresponds to the inner diameter of the top T of the truncated cones 17*a*, 17*b* of the central outer sleeve 17 in such a way that the lateral sleeves 18, 19 may be angled within the central outer sleeve 17 so as to allow an adjustment of the camber angle of the drive wheels 6, 7.

Each drive motor 13, 14 is operatively connected to a clutch 21 via the gearboxes 13*a*, 13*b* for connecting and disconnecting the hub assemblies 15, 16—and thereby the drive wheels 6, 7—from the drive motors 13, 14. The drive motors 13, 14 used in the shown embodiment are electric motors and the drive unit 1 includes a power supply and control interface unit 22 allowing power supply to the drive motors 13, 14 from an external battery pack 23 and connection with said control input means 8.

Again with reference to FIGS. 3 and 4, each quick release coupling 11 in this embodiment includes a quick-release shaft 24 connected to the hub assembly 15, 16 and provided with male splines 25 that mesh with corresponding female splines in the output shaft 26 of the clutch 21.

Figure 5:
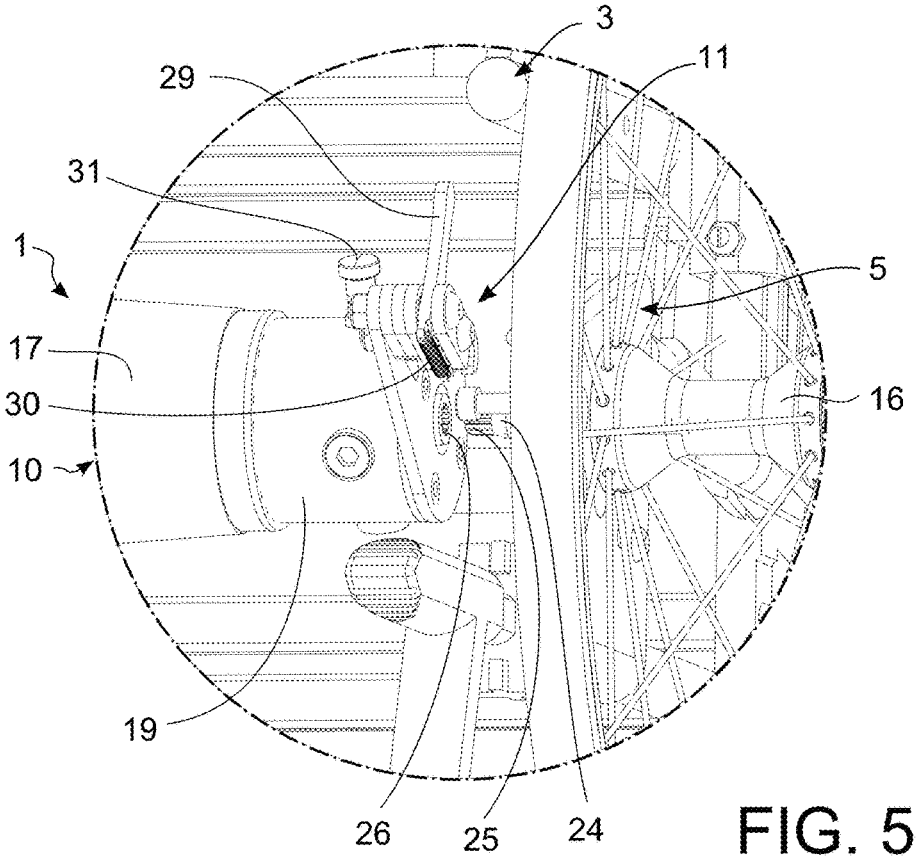
FIG. 5 is a cut-out perspective view of the quick release coupling of the drive unit, showing the drive unit just before installation.
Figure 6:
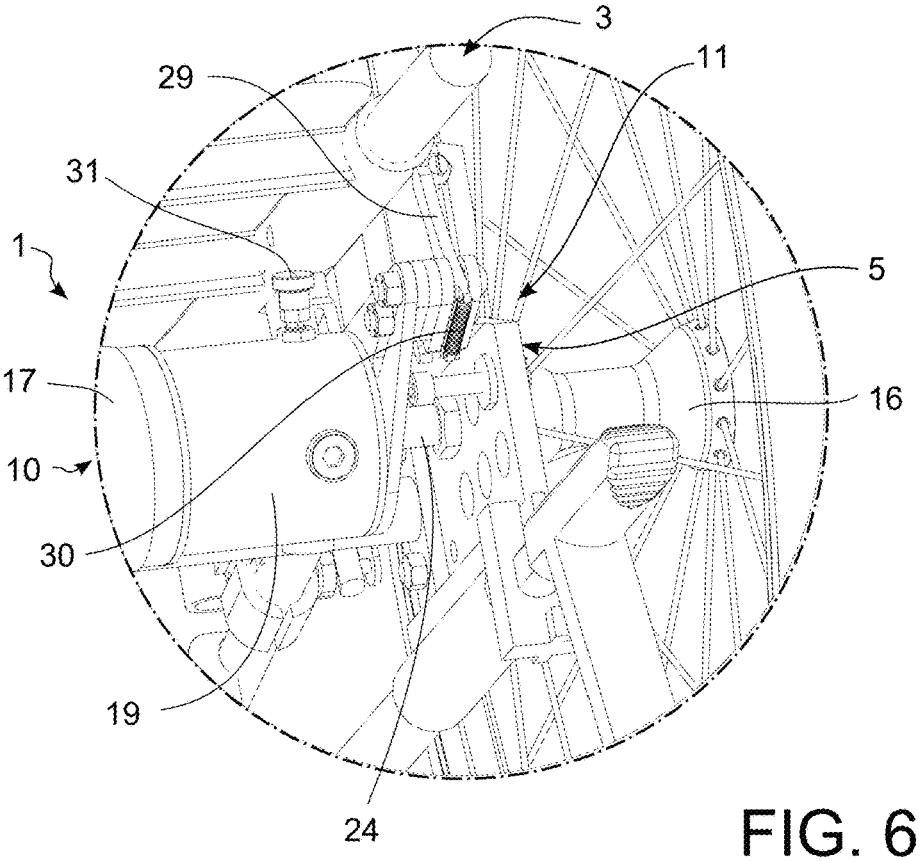
FIG. 6 is another cut-out perspective view of the quick release coupling, now showing the drive unit in its installed position.

In FIG. 5 and FIG. 6, the cut-out perspective views of the quick-release coupling 11 is shown up close externally, showing the drive unit 1 just before installation. The male splines 25 are clearly visible in FIG. 5 in a position just before entering the female splines 26 of the clutch 21. When connecting or disconnecting the drive wheels 6, 7 from the drive unit 1, a quick-release button 27 located in each hub assembly 15, 16 is pushed axially towards the drive unit 1. The quick-release buttons 27 are clearly visible in FIG. 3 and FIG. 4 and when pushed they axially move a push rod 28 which releases the quick-release shaft 24 from the clutch 21. The drive shaft housing 10 is mounted or dismounted from the lateral frame elements 4, 5 of the structural frame 3 of the wheelchair 2 by means of two quick-release levers 29 allowing easy removal or installation of the drive unit 1. The quick-release levers 29 are spring-biased by helical springs 30, as shown in FIG. 5 and FIG. 6. Furthermore, each clutch 21 is provided with a push-pull control knob 31 by means of which the drive motors 13, 14 may be connected or disconnected by a user.

Figure 7:
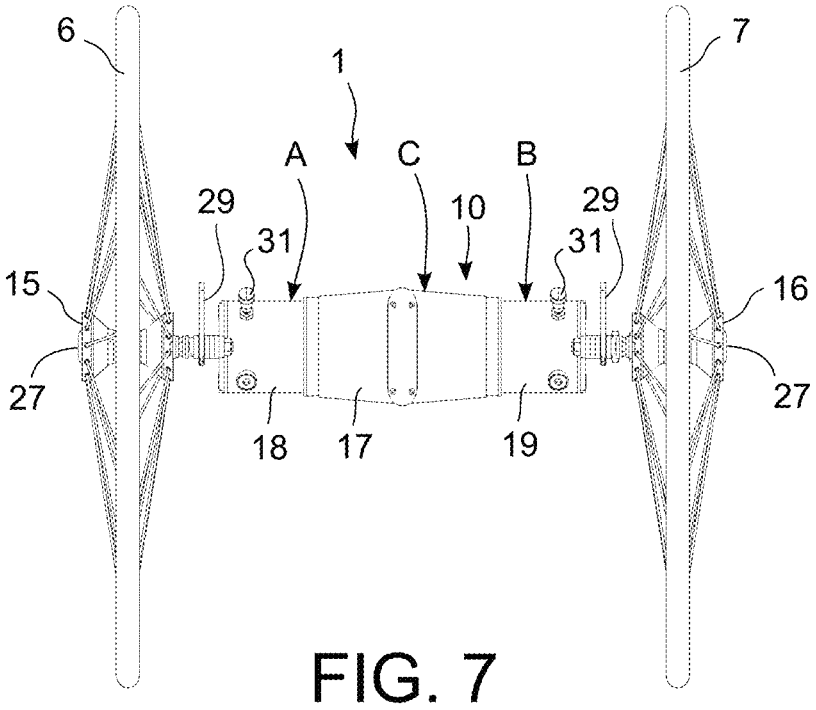
FIG. 7 is a view of the drive unit according to the first exemplifying embodiment with the two drive wheels attached, but where the wheelchair and its lateral frame elements have been omitted for the sake of clarity. The view shows the drive unit set to zero degrees camber angle.
Figure 8:
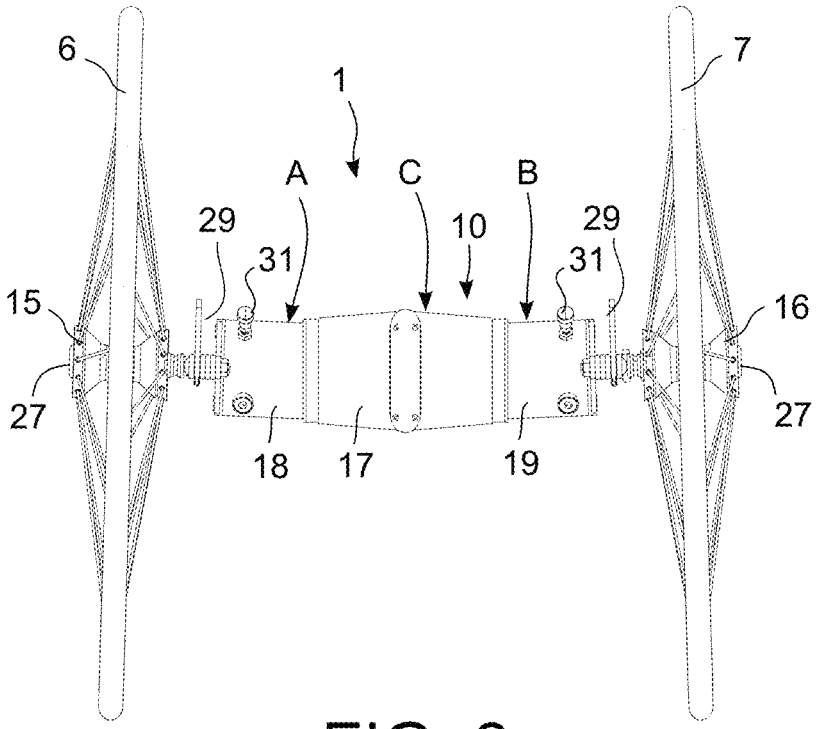
FIG. 8 is a view similar to the view of FIG. 7, but with the camber angle set to 4 degrees.

In FIG. 7, the drive unit 1 according to the first exemplifying embodiment is shown with the two drive wheels 6, 7 attached via the hub assemblies 15, 16. The wheelchair 2 and its lateral frame elements 4, 5 have been omitted for the sake of clarity. The view shows the drive unit 1 set to zero degrees camber angle. In FIG. 8 the camber angle is set to 4 degrees which is possible by setting the lateral sleeves 18, 19 at an angle within the central outer sleeve 17 so as to allow an adjustment of the camber angle of the drive wheels 6, 7. In order to save valuable weight, the lateral sleeves 18, 19 may favourably be made of a strong lightweight carbon-fibre material or similar.

Figure 9:
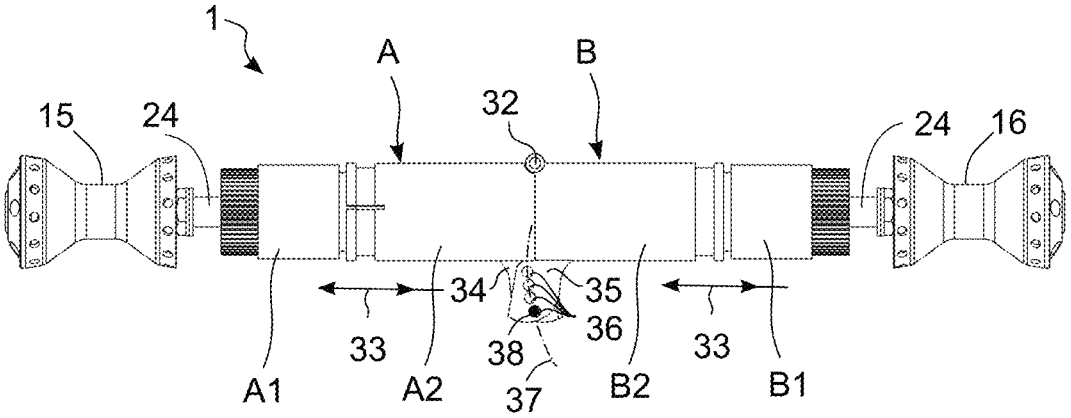
FIG. 9 is a view of the drive unit according to a second exemplifying embodiment with the two drive wheels attached, but where the wheelchair and its lateral frame elements have been omitted for the sake of clarity. The view shows the drive unit set to zero degrees camber angle.
Figure 10:
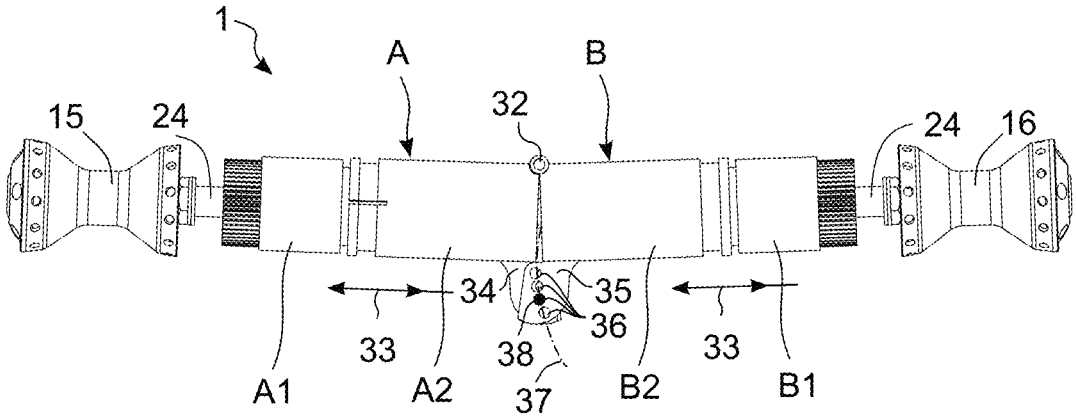
FIG. 10 is a view similar to the view of FIG. 7, but with the camber angle set to 4 degrees.

In FIG. 9 and FIG. 10, an alternative second exemplifying embodiment of the invention is shown, wherein the two sections A, B of the drive shaft housing 10 are attached to each other via a hinge pin 32 so as to allow an adjustment of the camber angle of the drive wheels 6, 7. Each section A, B includes sub-portions A1, A2, B1, B2, one of which is telescopically moveable with respect to the other in the axial direction of the drive unit 1 in order to allow width adjustment of the drive unit 1, as illustrated by the arrows 33. The two sections A, B of the drive shaft housing 10 each comprises a locking lug 34, 35 having a plurality of apertures 36 arranged along a curved geometrical symmetry line 37 to overlap and coincide with apertures of an opposite locking lug 34, 35 and to be interlocked with a common locking bolt 38 in such a way that only one opposite pair of apertures overlap and coincide at a certain angle between the two sections A, B corresponding to a certain camber angle of the drive wheels 6, 7. The view in FIG. 9 shows the drive unit 1 set to zero degrees camber angle, whilst the view in FIG. shows the drive unit 1 with the camber angle set to 4 degrees.

Figure 11:
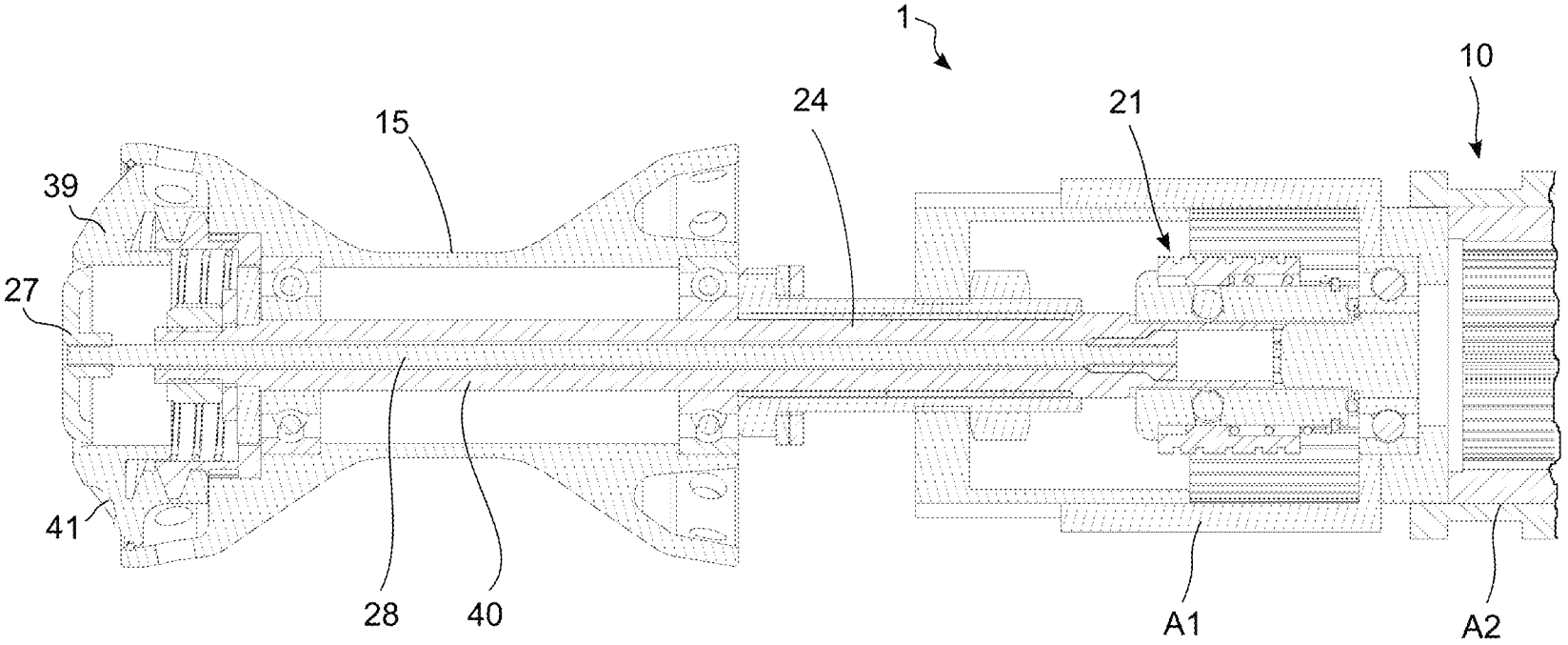
FIG. 11 is a cross-sectional partial view of the drive unit displaying the quick-release coupling according to a second exemplifying embodiment of the invention.

FIG. 11 is a cross-sectional partial view of the drive unit 1 displaying the release coupling according to the second exemplifying embodiment of the invention as described in FIGS. 9 and 10. This embodiment includes the same type of quick-release buttons 27 as in the first exemplifying embodiment described with reference to FIG. 1 through FIG. 8. The quick-release buttons 27 thus axially move a push rod 28 which releases the quick-release shaft 24 from the clutch 21. In this embodiment, however, the drive motors 13, 14 (not shown in this partial view) are connected and disconnected by means of a manual turning disc 39 which is operatively connected to the clutch 21 via a turning sleeve 40. As shown in the figure, the quick-release button 27 is positioned—and freely movable—in the center portion of the surrounding turning disc 39. The turning disc is provided with recesses 41 in order to provide a good turning grip for the user's fingers when connecting or disconnecting the motor drive.

It is to be understood that the present invention is not limited to the embodiments described above and illustrated in the drawings; rather, the skilled person will recognize that many changes and modifications may be made within the scope of the appended claims.

The invention claimed is:

1. A drive unit (1) in combination with a wheelchair (2), said wheelchair (2) comprising control input means (8) and a structural frame (3) with two lateral frame elements (4, 5), each of the two lateral frame elements (4, 5) supporting a respective one of two drive wheels (6, 7), said drive unit (1) comprising two drive motors (13, 14) mounted within a drive shaft housing (10) and adapted to drive the respective one of the two drive wheels (6, 7) independently of each other based on control input from a driver via the control input means (8), said drive shaft housing being releasably attached between the two lateral frame elements (4) of the wheelchair (2) and connected to the two drive wheels (6, 7) via quick-release couplings (11) arranged at each distal end (12) of the drive shaft housing (10), wherein:

the drive shaft housing (10) is divided into at least two sections (A, B), each of the two sections housing one of said two drive motors (13, 14);

the at least two sections (A, B) of the drive shaft housing (10) are telescopically moveable relative to each other for adjusting a width (w) of the drive shaft housing (10) to different wheelchairs having different distances between the lateral frame elements (4, 5) of the structural frame (3) of the wheelchair (2).

2. The drive unit (1) in combination with the wheelchair (2) according to claim 1, wherein the two sections (A, B) of the drive shaft housing (10) are arranged to be angled relative to each other so as to allow an adjustment of the camber angle of the two drive wheels (6, 7).

3. The drive unit (1) in combination with the wheelchair (2) according to claim 2, wherein:

the two sections (A, B) of the drive shaft housing (10) are attached to each other via a hinge pin (31) so as to allow an adjustment of the camber angle of the two drive wheels (6, 7);

each section includes sub-portions (Al, A2, Bl, B2), one of which is telescopically moveable with respect to the other in the axial direction of the drive unit (1) in order to allow width adjustment of the drive unit (1).

4. The drive unit (1) in combination with the wheelchair (2) according to claim 3, wherein said two sections (A, B) of the drive shaft housing (10) each comprises a locking lug (34, 35) having a plurality of apertures (36) arranged along a curved geometrical symmetry line (37) to overlap and coincide with apertures (36) on the opposite locking lug (34, 35) and to be interlocked with a common locking bolt (38) in such a way that only one opposite pair of apertures (36) overlap and coincide at a certain angle between the two sections (A, B), corresponding to a certain camber angle of the two drive wheels (6, 7).

5. The drive unit (1) in combination with the wheelchair (2) according to claim 2, wherein the two drive motors (13, 14) are positioned coaxially relative to the respective rotational axis of the two drive wheels (6, 7).

6. The drive unit (1) in combination with the wheelchair (2) according to claim 2, wherein the drive shaft housing (10) is substantially cylindrically shaped and arranged to be installed in coaxial alignment with the rotational axis of the two drive wheels (6, 7).

7. The drive unit (1) in combination with the wheelchair (2) according to claim 2, wherein the drive shaft housing (10) is divided into three sections (A, B, C) comprising a central outer sleeve (17) and two lateral inner sleeves (18, 19) containing the two drive motors (13, 14), at least one of said two inner sleeves (18, 19) being telescopically moveable within the central outer sleeve (17) in the axial direction of the drive unit (1).

8. The drive unit (1) in combination with the wheelchair (2) according to claim 1, wherein the two drive motors (13, 14) are positioned coaxially relative to the respective rotational axis of the two drive wheels (6, 7).

9. The drive unit (1) in combination with the wheelchair (2) according to claim 8, wherein the drive shaft housing (10) is substantially cylindrically shaped and arranged to be installed in coaxial alignment with the rotational axis of the two drive wheels (6, 7).

10. The drive unit (1) in combination with the wheelchair (2) according to claim 8, wherein the drive shaft housing (10) is divided into three sections (A, B, C) comprising a central outer sleeve (17) and two lateral inner sleeves (18, 19) containing the two drive motors (13, 14), at least one of said two inner sleeves (18, 19) being telescopically moveable within the central outer sleeve (17) in the axial direction of the drive unit (1).

11. The drive unit (1) in combination with the wheelchair (2) according to claim 1, wherein the drive shaft housing (10) is substantially cylindrically shaped and arranged to be installed in coaxial alignment with the rotational axis of the two drive wheels (6, 7).

12. The drive unit (1) in combination with the wheelchair (2) according to claim 11, wherein the drive shaft housing (10) is divided into three sections (A, B, C) comprising a central outer sleeve (17) and two lateral inner sleeves (18, 19) containing the two drive motors (13, 14), at least one of said two inner sleeves (18, 19) being telescopically moveable within the central outer sleeve (17) in the axial direction of the drive unit (1).

13. The drive unit (1) in combination with the wheelchair (2) according to claim 1, wherein the drive shaft housing (10) is divided into three sections (A, B, C) comprising a central outer sleeve (17) and two lateral inner sleeves (18, 19) containing the two drive motors (13, 14), at least one of said two inner sleeves (18, 19) being telescopically moveable within the central outer sleeve (17) in the axial direction of the drive unit (1).

14. The drive unit (1) in combination with the wheelchair (2) according to claim 13, wherein the central outer sleeve (17) is formed as two truncated cones (17*a*, 17*b*) adjoined at the base of the cones;

the two lateral sleeves (18, 19) are cylindrically shaped and each contains one of the two drive motors (13, 14);

the outer diameter of the lateral sleeves (18, 19) essentially corresponds to the inner diameter of the top (T) of the truncated cones (17*a*, 17*b*) of the central outer sleeve (17) in such a way that the lateral sleeves (18, 19) may be angled within the central outer sleeve (17) so as to allow an adjustment of the camber angle of the two drive wheels (6, 7).

15. The drive unit (1) in combination with the wheelchair (2) according to claim 1, wherein each drive motor (13, 14)

is operatively connected to a clutch (21) for connecting and disconnecting the two drive wheels (6, 7) from the two drive motors (13, 14).

16. The drive unit (1) in combination with the wheelchair (2) according to claim 1, wherein the control input means (8) includes push rims (9) attached to each drive wheel (6, 7).

17. The drive unit (1) in combination with the wheelchair (2) according to claim 16, wherein the drive unit (1) further includes a drive control system for receiving drive control input from sensors coupled to the push rims (9) of both of the two drive wheels (6, 7), said sensors being adapted to detect a driver-requested drive torque for each drive wheel (6, 7) based on the driver's detected hand force transferred to the push rims (9) of the two drive wheels (6, 8).

18. The drive unit (1) in combination with the wheelchair (2) according to claim 1 wherein the control input means (8) includes a joystick.

19. The drive unit (1) in combination with the wheelchair (2) according to claim 1, the two drive motors (13, 14) are electric motors and that the drive unit (1) includes a power supply and control interface unit (22) allowing power supply to the two drive motors (13, 14) from an external battery pack (23) and connection with said control input means (8).

20. A drive unit (1) in combination with a wheelchair (2), said wheelchair (2) comprising two drive wheels (6, 7), an input control means (8), and a structural frame (3) with two lateral frame elements (4, 5), each of the two lateral frame elements (4, 5) supporting one of the two drive wheels (6, 7), said drive unit (1) comprising two drive motors (13, 14) mounted within a drive shaft housing (10), each of the two drive motors (13, 14) adapted to drive a respective one of the two drive wheels (6, 7) independently of each other based on control input from a driver via the control input means(8), said drive shaft housing being releasably attached between the two lateral frame elements (4) of the wheelchair (2) and connected to the two drive wheels (6, 7) via quick-release couplings (11) arranged at each distal end (12) of the drive shaft housing (10), wherein, the drive shaft housing (10) is divided into at least two sections (A, B), each of the two sections housing one of said two drive motors (13, 14), the drive shaft housing (10) is substantially cylindrically shaped and arranged to be installed in coaxial alignment with the rotational axis of the two drive wheels (6, 7), and the at least two sections (A, B) of the drive shaft housing (10) are telescopically moveable relative to each other for adjusting a width (w) of the drive shaft housing (10) to allow the drive unit to connect to wheelchairs having different distances between lateral frame elements (4, 5) of a structural frame (3) of the other wheelchairs (2).

* * * * *